US007866309B2

(12) United States Patent
Juan

(10) Patent No.: US 7,866,309 B2
(45) Date of Patent: Jan. 11, 2011

(54) SINGLE-CHAMBER TYPE FIRING MECHANISM OF PAINTBALL GUN

(75) Inventor: Chih-Chen Juan, Taichung County (TW)

(73) Assignee: Yongmart Manufacturing Co., Ltd., Taichung County (TW)

( * ) Notice: Subject to any disclaimer, the term of this patent is extended or adjusted under 35 U.S.C. 154(b) by 155 days.

(21) Appl. No.: 12/397,519

(22) Filed: Mar. 4, 2009

(65) Prior Publication Data

US 2010/0206283 A1 Aug. 19, 2010

(30) Foreign Application Priority Data

Feb. 19, 2009 (TW) ..... 98105348 A

(51) Int. Cl.
*F41B 11/00* (2006.01)

(52) U.S. Cl. ..... 124/73; 124/75; 124/76; 124/77

(58) Field of Classification Search ..... 124/71–77
See application file for complete search history.

(56) References Cited

U.S. PATENT DOCUMENTS 3,463,136 A * 8/1969 Joslyn et al. ..... 124/76
5,063,905 A * 11/1991 Farrell ..... 124/72
6,003,504 A * 12/1999 Rice et al. ..... 124/73
2004/0237954 A1* 12/2004 Styles et al. ..... 124/77
2005/0000505 A1* 1/2005 Pedicini et al. ..... 124/63
2007/0028909 A1* 2/2007 Wood ..... 124/73
2008/0078971 A1* 4/2008 Quinn et al. ..... 251/205
2009/0056693 A1* 3/2009 Pedicini et al. ..... 124/73
2009/0101129 A1* 4/2009 Wood et al. ..... 124/77

* cited by examiner

*Primary Examiner*—Troy Chambers
(74) *Attorney, Agent, or Firm*—Browdy and Neimark, PLLC

(57) ABSTRACT

A firing assembly of a paintball gun includes a piston, a spring, and a valve installed in a chamber in a frame of the paintball gun. The piston is a bar-like member having front member, a connection member, and a rear member. The connection member is smaller than the front member and the rear member to form a space thereunder. The valve is in the space to divide the space into a front room and a rear room. The spring urges the piston forward to have the rear member pressing an actuator of the valve that a high pressure gas will escape out of the valve to spurt out of the apertures via the rear room, the channels, and the front room. The high pressure also pressurizes the rear member to move the piston backward and compress the spring.

11 Claims, 7 Drawing Sheets

SINGLE-CHAMBER TYPE FIRING MECHANISM OF PAINTBALL GUN

BACKGROUND OF THE INVENTION

1. Field of the Invention

The present invention relates generally to a paintball gun, and more particularly to a paintball gun having a firing assembly in one chamber.

2. Description of the Related Art

FIG. 7 shows a conventional double-chamber type paint ball gun 90 including a frame 92 having two chambers therein, named an upper chamber 94 and a lower chamber 96. A barrel 98 is connected to a front end of the upper chamber 94, and a ball feeding tube 100 on a top of the frame and communicated with the upper chamber 94. The ball feeding tube 100 is connected with a hopper (not shown) that paint balls will drop to the upper chamber 94 in sequence. The frame 92 further has an opening 102 between the upper chamber 94 and the lower chamber 96. A gas valve 104 is provided in the lower chamber 96 and under the opening 102. A gas tube 106 is connected to a front end of the lower chamber 96. The gas tube 106 is connected to a high pressure gas source (not shown). The gas valve 104 is normally closed. An impact piston 110 is received in the lower chamber 96 for reciprocation, and a spring 112 is also received in the lower chamber 96 for biasing the impact piston 110 forward. A lock device 114 is connected to a trigger 116 to lock the impact piston 110 at a rear of the lower chamber 96. A firing piston 118 is received in the upper chamber 94 for reciprocation. A post 120 is provided to connect the impact piston 110 and the firing piston 118. The firing piston 118 has a lot of apertures 122.

When a shooter pulls the trigger 116, the lock device 114 will disengage the impact piston 110 that the spring 112 urges the impact piston 110 and the firing piston 118 forward. The impact piston 110 will impact an actuator 108 of the gas valve 104 to allow a high pressure gas flows to the upper chamber 94 via the opening 102. At last, the high pressure gas spurts out of the apertures 122 to fire a paintball (not shown) in front of the firing piston 118 out of the barrel 98. In the meantime of the impact piston 110 impacting the actuator 108 of the gas valve 104, some high pressure gas will exert on the impact piston 110 to push it, along with the firing piston 11 8, backward. If the lock device 114 engages the impact piston 110, that is a single action, and the other paintball will be fired only when the shooter pulls the trigger 116 again. If the lock device 114 is kept in a position disengaged with the impact piston 110, that is an automatic action, and paintballs will be fired continuously.

The conventional paintball gun has a complex firing mechanism that such paintball gun malfunctions frequently. Besides, the double-chamber design needs large space that the conventional paintball gun always has a greater size.

SUMMARY OF THE INVENTION

The primary objective of the present invention is to provide a paintball gun having a firing mechanism mounted in a single chamber that the paintball gun has less chance to get malfunction.

The secondary objective of the present invention is to provide a paintball gun having a firing mechanism mounted in a single chamber that the firing mechanism needs smaller space to reduce the size of the paintball gun.

According to the objectives of the present invention, a paintball gun includes a frame having a chamber therein, a tube connected to the chamber of the frame to supply a high pressure gas, and a barrel connected to a front end of the chamber of the frame. A firing assembly, which is received in the chamber of the frame, includes a piston having an impact portion, a stop portion facing the impact portion, and a plurality of apertures on a front end thereof, a spring urging the piston toward the barrel, and a valve having an actuator facing the impact portion of the piston. The valve is located between the impact portion and the stop portion of the piston to form a front room between the valve and the stop portion and a rear room between the valve and the impact portion, and the rear room is communicated with the front room through a channel. The piston is moved by the spring to have the impact portion pressing the actuator of the valve that the high pressure gas from the tube flows out of the valve and into the rear room, and then the high pressure gas flows to the front room through the channel and spurts out of the apertures to fire a paintball, and in the meantime, the high pressure gas in the rear room presses the impact portion to move the piston backward and compress the spring.

DETAILED DESCRIPTION OF THE INVENTION

Figure 1:
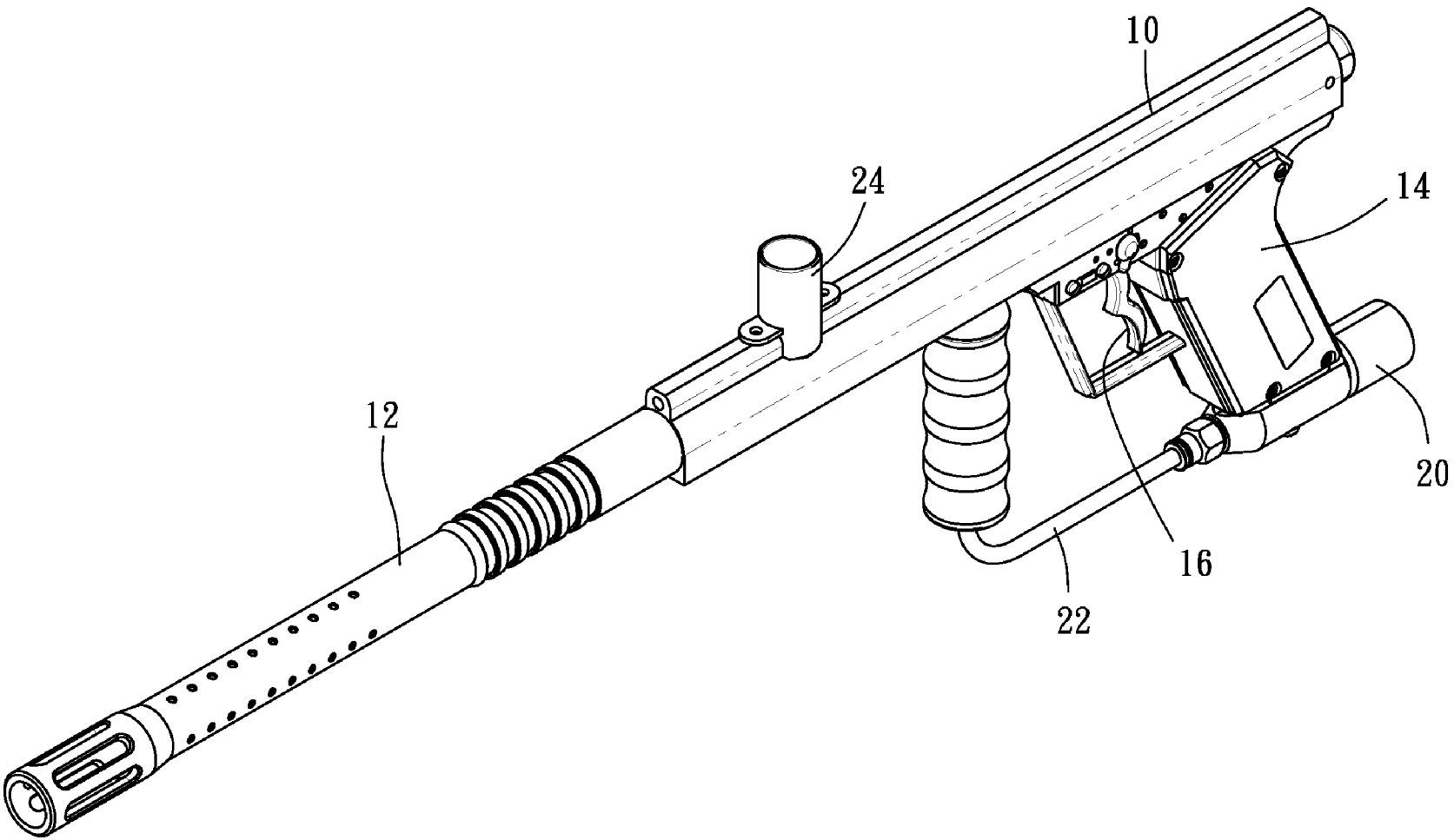
FIG. 1 is a perspective view of a preferred embodiment of the present invention.

As shown in FIG. 1, a paintball gun of the preferred embodiment of the present invention includes a frame 10, a barrel 12 at a front of the frame 10, a handle 14 and a trigger 16 at a bottom of the frame 10. The trigger 16 connects a lock device 18. An adaptor 20 is provided at a bottom of the handle 14, and a tube 22 has an end connected to the adaptor 20 and the other end extending into the frame 10. A feeding tube 24 is provided on a top of the frame 10 to connect a hopper (not shown). The above elements are as same as the conventional paintball gun, so we do not describe the detail here.

Figure 2:
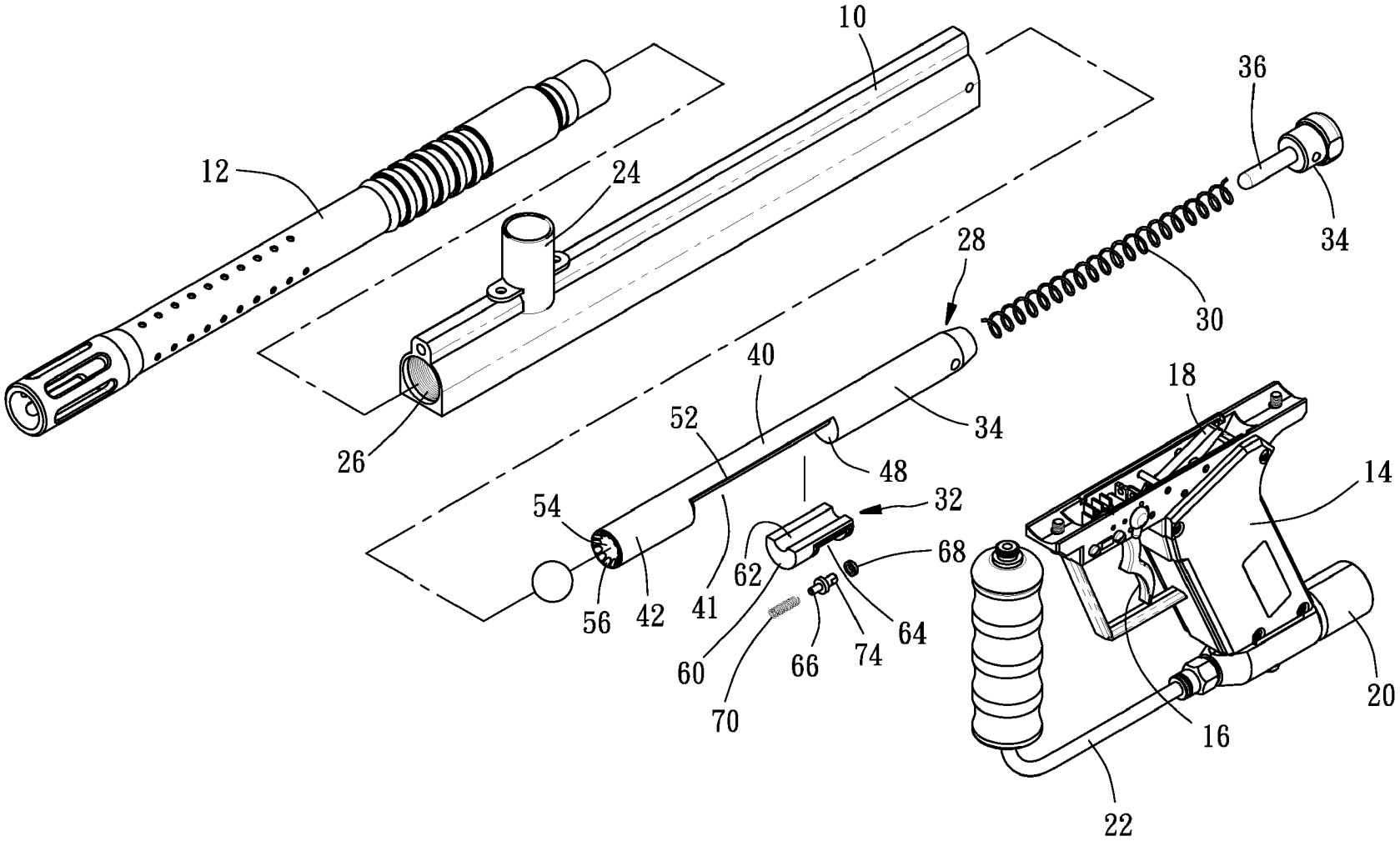
FIG. 2 is an exploded view of the preferred embodiment of the present invention.
Figure 3:
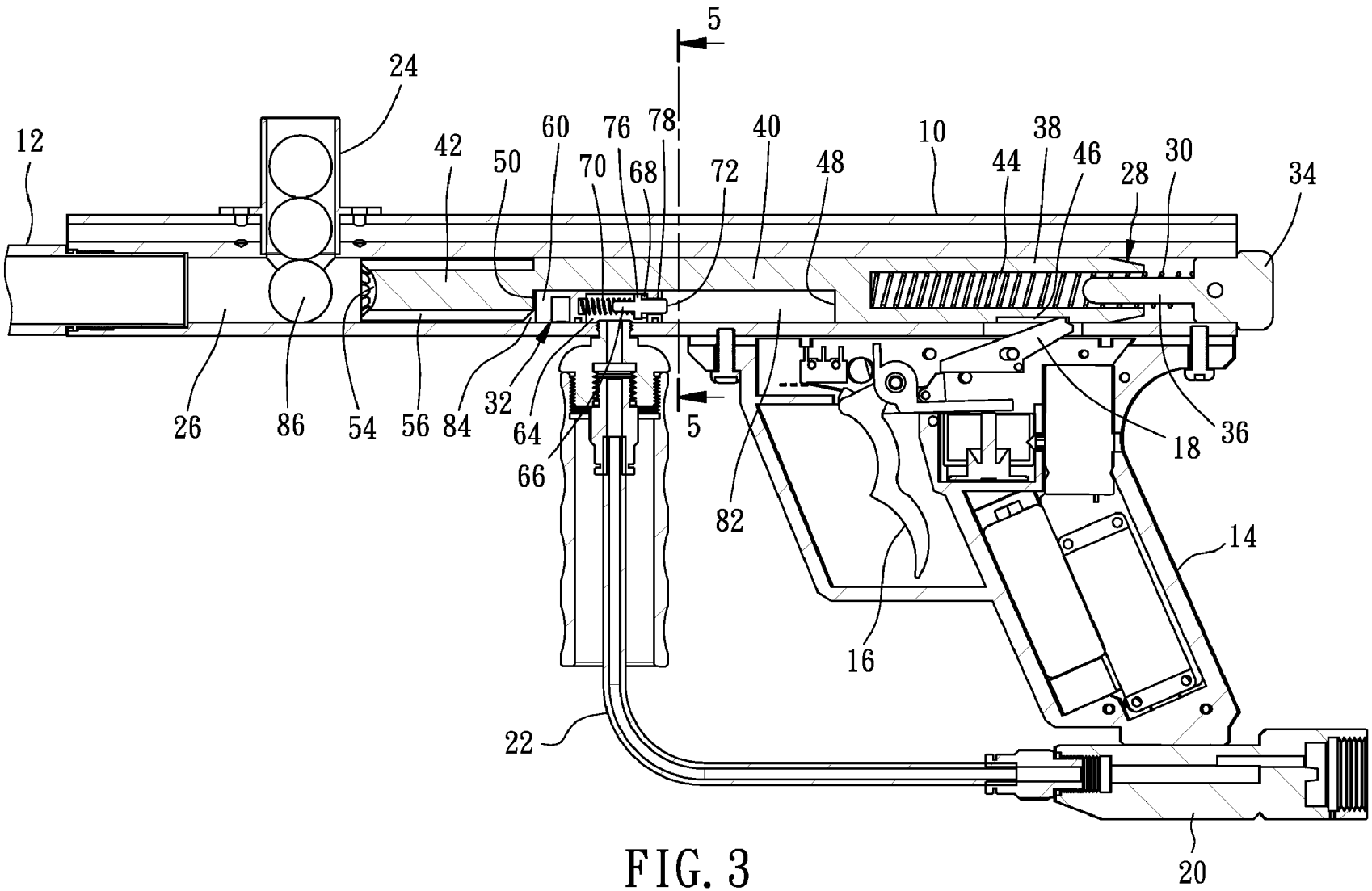
FIG. 3 is a sectional view of the preferred embodiment of the present invention.

As shown in FIG. 2 and FIG. 3, the frame 10 has only one chamber 26 therein, in which a firing assembly is received. The firing assembly includes a piston 28, a spring 30, a valve 32, and a plug 34.

The plug 34 seals a rear end of the chamber 26. The plug 34 has a post at an inner end thereof to fit the spring 30 thereon.

The piston 28 is a straight bar including a rear member 38, a connection member 40, and a front member 42. The rear member 38 has a hole 44 at a rear end thereof to receive the spring 30 therein and a recess 46 to be engaged with the lock device 18. The connection member 40 is between the rear member 38 and the front member 42 with a diameter smaller than that of the rear member 38 and the front member 42 that a space 41 is formed under the connection member 40 and between the rear member 38 and the front member 42. At a rear of the space 41, that is an inner end of the rear member 38, is an impact portion 48, and at a front of the space 41, that is an inner end of the front member 42, is a stop portion 50. The connection member 40 has a strip-like guiding portion 52 on a bottom thereof. The front member 42 has a concave portion 54 and a plurality of apertures 56 on a front end thereof. The apertures 56 extend to the stop portion 50. The stop portion 50 has an annular bevel surface 58, and the rear ends of the apertures 56 are on the bevel surface 58.

Figure 5:
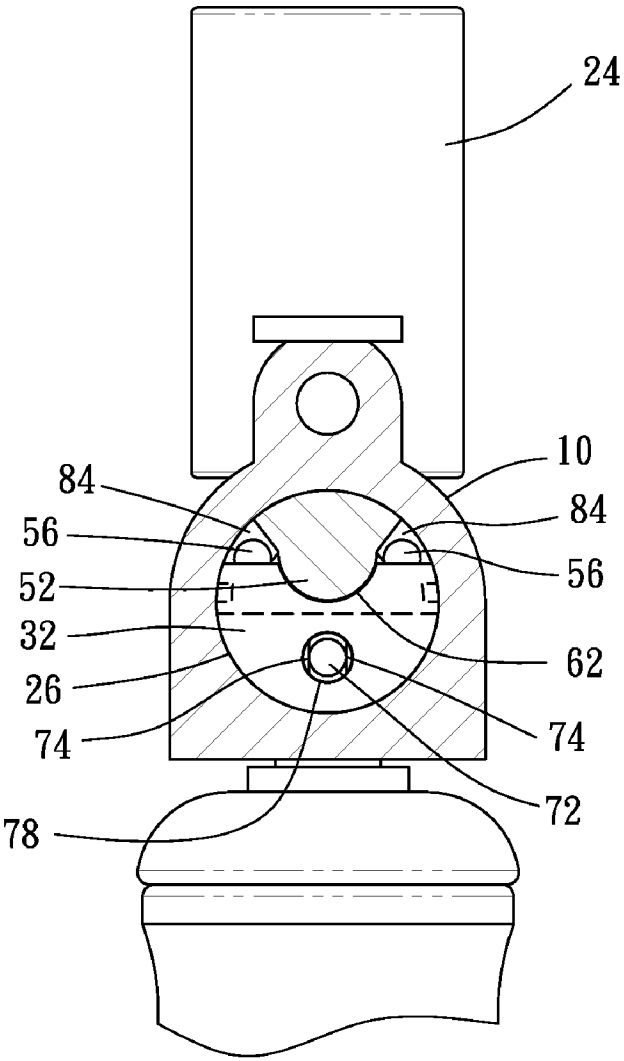
FIG. 5 is a sectional view along the 5-5 line of FIG. 4.

The valve 32 is mounted on a sidewall of the chamber 26 and connected to the tube 22. The valve 32 has a semi-column valve body 60 with a recess-like complementary guiding portion 62 on a flat top thereof, a valve chamber 64 on a bottom, and a hole 78 on a rear end communicated with the valve chamber 64. In the valve chamber 64, a pole 66, a sealing member 68, and a spring 70 are provided. The pole 66 has an actuator 72 at an end thereof, and the actuator 72 has two gas flowing portions 74, which are two flat faces on the actuator 72. The pole 66 further has a ring 76 at a middle thereof. The sealing member 68 is an O-ring fitted to the pole 66 from the actuator 72. The spring 70 is fitted to the pole 66 at an end opposite the actuator 72, and the actuator 72 is extended out of the valve body 60 via the hole 78. The spring 70 urges the pole 66 with the ring 76 pressing the sealing member 68 on an inner side of the valve body 60 that the sealing member 68 may seal the hole 78. Therefore, the valve 32 is normally closed. The valve 32 is in the space 41 of the piston 28 with the complementary guiding portion 62 fitted to the guiding portion 52 of the piston 28 that the valve 32 divides the space 41 into a front room 80 and a rear room 82. Two channels 84, as shown in FIG. 5, are formed between the valve body 60 and the connection member 40 to communicate the front room 80 and the rear room 82.

Figure 4:
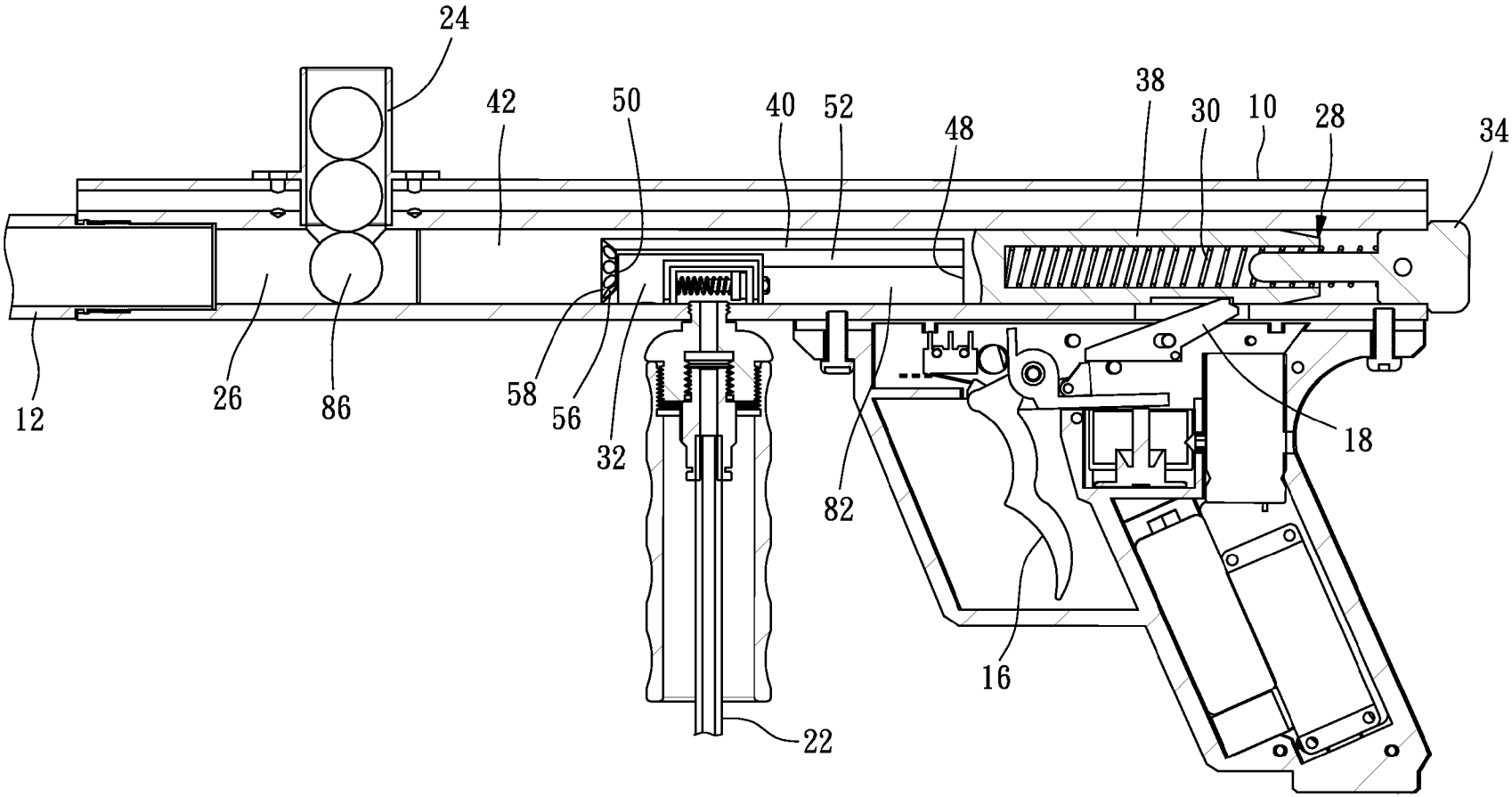
FIG. 4 is a sectional view of the preferred embodiment of the present invention, showing the piston at a ready position to fire a paintball.

As shown in FIG. 4, the piston 28 is pulled backward to compress the spring 30, and the lock device 18 is engaged with the recess 46 of the piston 28. Now, the paintball gun is ready to fire. In this condition, the valve 32 is very close to the stop portion 50, which means the size of the front room 80 is very small, and the valve 32 is still closed that a high pressure gas from the tube 22 can not flow to the chamber 26. A paintball 86 drops into the chamber 26 from the feeding tube 24 in front of the piston 28.

Figure 6:
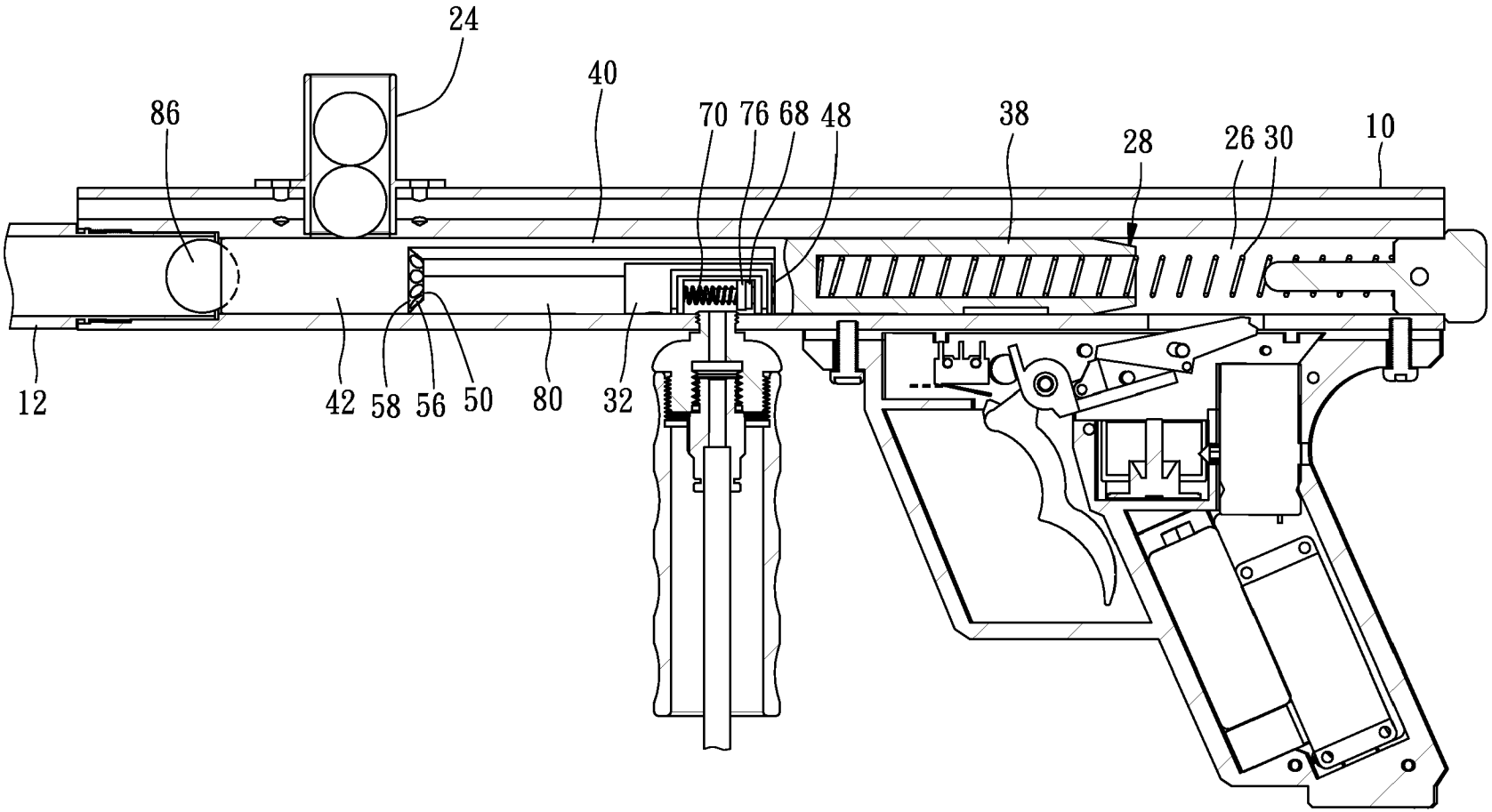
FIG. 6 is a sectional view of the preferred embodiment of the present invention, showing the piston firing the paintball.
Figure 7:
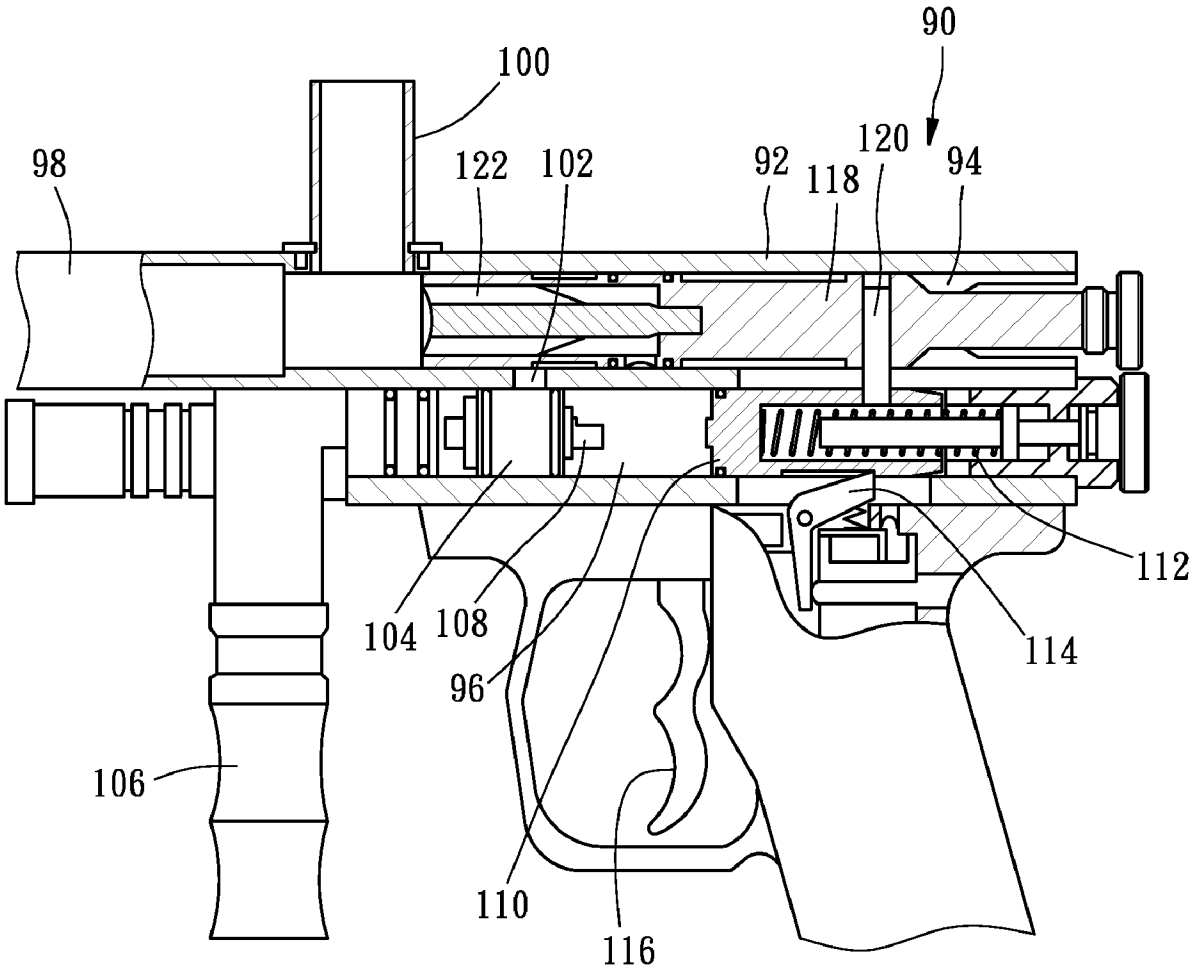
FIG. 7 PRIOR ART
FIG. 7 is a sectional view of the conventional paintball gun.

When s shooter pulls the trigger 16, as shown in FIG. 6, the lock device 18 disengages the piston 28, and the spring 30 urges the piston 28 forward to have the impact portion 48 pressing the actuator 72 of the valve 32 that the sealing member 68 is no more sealing the hole 78. In the meantime, the gas flowing portions 74 are in the hole 78 to provide a sufficient space for the high pressure gas escaping out of the valve 32. The high pressure gas enters the rear room 82 directly, and then, the gas flows to the front room 84 through the channels 84, and spurts out of the apertures 56 to fire the paintball 86. In the meantime, the gas also exerts the impact portion 48 to move the piston 28 backward to the position shown in FIG. 3. While the lock member 18 is still kept at a disengaging position, the spring 30 will move the piston 28 forward again when the valve 32 touches the stop portion 50 for continuously firing paintballs.

In conclusion, the elements of the firing assembly of the present invention are installed in one chamber and complete all of the procedures of firing paintballs. The structure of the firing assembly is not complex that we have less chance to get malfunction. The space for installation of the firing assembly is smaller than the conventional device that the paintball gun of the present invention may reduce its size.

What is claimed is:

1. A paintball gun, comprising:

a frame having a chamber therein;

a tube connected to the chamber of the frame to supply a high pressure gas;

a barrel connected to a front end of the chamber of the frame;

a piston, which is received in the chamber of the frame for reciprocation, having an impact portion, a stop portion facing the impact portion, and a plurality of apertures on a front end thereof;

a spring received in the chamber of the frame to urge the piston toward the barrel; and a valve, which is mounted in the chamber of the frame and connected to the tube, having an actuator facing the impact portion of the piston;

wherein the valve is located between the impact portion and the stop portion of the piston to form a front room between the valve and the stop portion and a rear room between the valve and the impact portion, and the rear room is communicated with the front room through a channel;

wherein the piston is moved by the spring to have the impact portion pressing the actuator of the valve that the high pressure gas from the tube flows out of the valve and into the rear room, and then the high pressure gas flows to the front room through the channel and spurts out of the apertures to fire a paintball, and in the meantime, the high pressure gas in the rear room presses the impact portion to move the piston backward and compress the spring.

2. The paintball gun as defined in claim 1, wherein the piston is provided with a guiding portion, and the valve has a complementary guiding portion fitted to the guiding portion of the piston.

3. The paintball gun as defined in claim 1, wherein the piston has a bevel surface on the stop portion, and the apertures have inner ends on the bevel surface.

4. The paintball gun as defined in claim 1, wherein the actuator of the valve has a gas flowing portion.

5. The paintball gun as defined in claim 1, wherein the piston has a concave portion at the front end thereof, and the apertures have outer ends on the concave portion.

6. A firing assembly of a paintball gun, which the paintball gun includes a frame having a chamber therein, a tube connected to the chamber of the frame to supply a high pressure gas, and a barrel connected to a front end of the chamber of the frame, comprising:

a piston, which is received in the chamber of the frame for reciprocation, having a front member having a plurality of apertures, a rear member, and a connection member between the front member and the rear member, wherein a diameter of the connection member is smaller than that of the front member and the rear member that a space is formed between the front member and the rear member;

a spring received in the chamber of the frame to urge the piston toward the barrel; and a valve, which is mounted in the chamber of the frame and connected to the tube, having an actuator facing the impact portion of the piston;

wherein the valve is located in the space between the front member and the rear member of the piston to form a front room between the valve and the front member and a rear room between the valve and the rear member, and the rear room is communicated with the front room through a channel;

wherein the piston is moved by the spring to have the rear member pressing the actuator of the valve that the high pressure gas from the tube flows out of the valve and into the rear room, and then the high pressure gas flows to the front room through the channel and spurts out of the apertures of the front member to fire a paintball, and in the meantime, the high pressure gas in the rear room presses the rear member to move the piston backward and compress the spring.

7. The firing assembly of the paintball gun as defined in claim 6, wherein the piston is provided with a guiding portion on the connection portion, and the valve has a complementary guiding portion fitted to the guiding portion of the piston.

8. The firing assembly of paintball gun as defined in claim 7, wherein the connection portion of the piston has a flat side, on which the guiding portion is provided, and the valve has a semi-column valve body having a flat side, which the complementary guiding portion is provided.

9. The firing assembly of the paintball gun as defined in claim 6, wherein the piston has a bevel surface on the stop portion, and the apertures have inner ends on the bevel surface.

10. The firing assembly of paintball gun as defined in claim 1, wherein the actuator of the valve has a gas flowing portion.

11. The firing assembly of paintball gun as defined in claim 1, wherein the piston has a concave portion at the front end thereof, and the apertures have outer ends on the concave portion.

* * * * *